US011317693B2

(12) United States Patent
Garib

(10) Patent No.: US 11,317,693 B2
(45) Date of Patent: May 3, 2022

(54) NAIL POLISH REMOVING DEVICE

(71) Applicant: Jenny Garib, West Palm Beach, FL (US)

(72) Inventor: Jenny Garib, West Palm Beach, FL (US)

( * ) Notice: Subject to any disclaimer, the term of this patent is extended or adjusted under 35 U.S.C. 154(b) by 166 days.

(21) Appl. No.: 15/894,955

(22) Filed: Feb. 13, 2018

(65) Prior Publication Data

US 2019/0246766 A1 Aug. 15, 2019

(51) Int. Cl.
*A45D 34/04* (2006.01)
*A45D 29/18* (2006.01)
*A45D 29/00* (2006.01)

(52) U.S. Cl.
CPC ..... *A45D 34/04* (2013.01); *A45D 29/007* (2013.01); *A45D 29/18* (2013.01); *A45D 2200/051* (2013.01)

(58) Field of Classification Search
CPC ..... A45D 29/007; A45D 29/17; A45D 29/22; A45D 34/04; A61B 17/54; A61H 35/006; A61G 13/124
USPC ..... 132/200, 73, 76.4, 75.6; D28/56, 57, 61, D28/63; D7/553.5, 554.3; 15/97.1, 21.1, 15/167.1, 167.3; D24/205; 206/581
See application file for complete search history.

(56) References Cited

U.S. PATENT DOCUMENTS

D53,973 S * 10/1919 Sterling ..... D28/61
2,389,822 A * 11/1945 Simmons ..... A45D 29/18 34/202
2,424,509 A * 7/1947 Singer ..... A47K 7/043 15/97.1
2,644,446 A * 7/1953 Viniegra ..... A61H 23/0218 601/80
3,916,920 A * 11/1975 Tsukamoto ..... A45D 29/14 132/73
3,966,335 A * 6/1976 Abramson ..... A46B 9/02 401/10
4,022,228 A * 5/1977 Ropp et al. ..... A45D 29/17 132/75
4,282,891 A * 8/1981 Duceppe ..... A45D 29/007 132/73.5
4,440,181 A * 4/1984 Scherer ..... A45D 29/007 132/73.5
4,476,883 A * 10/1984 Diaz ..... A45D 29/00 132/73

(Continued)

FOREIGN PATENT DOCUMENTS

CA 2439837 A1 * 3/2005 ..... A45D 29/007
FR 2212746 A5 * 7/1974 ..... A45D 29/18
GB 2519591 A * 4/2015 ..... A45D 29/22

OTHER PUBLICATIONS

Meizhoushi (https://web.archive.org/web/20150325123729/https://www.amazon.com/Brand-Manicure-Finger-Treatment-Remover/dp/B00A8DHH1E); Mar. 25, 2015.*

(Continued)

*Primary Examiner* — Nicholas D Lucchesi
(74) *Attorney, Agent, or Firm* — Gregory M. MacDonald

(57) ABSTRACT

The present invention relates to nail polish removers. More particularly, the present invention is a nail polish removing device, which includes a container with a fluid compartment to hold nail polish remover such as acetone, a plurality of openings to receive more than one finger, and a plurality of spokes to facilitate the removal of nail polish from fingernails.

6 Claims, 3 Drawing Sheets

(56) References Cited

U.S. PATENT DOCUMENTS 4,510,954 A 4/1985 Miller
4,530,726 A * 7/1985 Montiel ..... A45D 29/007 132/73.5
4,800,606 A * 1/1989 Kolesky ..... A45D 29/007 132/73.6
4,964,372 A * 10/1990 Zeenni ..... A45D 29/007 132/74.5
5,065,778 A * 11/1991 Terrell ..... A45D 29/007 132/73
5,823,203 A * 10/1998 Carroll ..... A45D 29/007 132/200
D402,411 S * 12/1998 Radler ..... D28/61
5,855,212 A * 1/1999 Walker ..... A45D 29/007 132/73.5
5,992,422 A * 11/1999 Ivory ..... A45D 29/007 132/73
6,116,248 A * 9/2000 Walker ..... A45D 29/007 132/74.5
6,314,965 B1 * 11/2001 Walker ..... A45D 29/007 132/74.5
6,901,935 B2 6/2005 Chang
8,646,898 B2 * 2/2014 Bitoh ..... A45D 29/00 118/300
2010/0218780 A1 * 9/2010 Hurman ..... A45D 29/00 132/73
2016/0045010 A1 * 2/2016 Jin ..... A45D 29/007 132/200

OTHER PUBLICATIONS

SafeCosmetics (https://web.archive.org/web/20190703112701/http://www.safecosmetics.org/get-the-facts/chemicals-of-concern/nail-polish-removers/).*

* cited by examiner

NAIL POLISH REMOVING DEVICE

CROSS-REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR

Not Applicable

BACKGROUND

Unless otherwise indicated herein, the materials described in this section are not prior art to the claims in this application and are not admitted to be prior art by inclusion in this section.

1. Field of the Invention

The present invention relates generally to nail polish removers. More particularly, the present invention is a nail polish removing device, which includes a container with a fluid compartment to hold nail polish remover such as acetone, a plurality of openings to receive more than one finger, and a plurality of spokes to facilitate the removal of nail polish from a fingernail.

2. Description of Related Art

Many people use nail polish to add an aesthetic appeal to their fingernails. People need to remove the nail polish after it becomes chipped or worn. This is usually a difficult and tedious task. Current methods to remove nail polish from fingernails only allow a person to remove the nail polish from one fingernail at a time. Since removing nail polish is a difficult and time consuming task, people may instead pay a nail salon to remove the nail polish.

Accordingly, there is a need for a device or method to remove nail polish from a user's fingernails that is easy, quick, and inexpensive. The device and method described in this patent application fulfills at least one of these needs or creates other utility.

BRIEF SUMMARY OF THE INVENTION

It is a principal object to solve at least one of the disadvantages with other attempted solutions or to create other utility by providing a device or method that is easy, quick, and inexpensive, which allows for the removal of nail polish from more than one fingernail or toenail at a time.

The present invention provides a nail polish removing device and method that easily, quickly, and inexpensively removes nail polish from a user's fingernails or toenails. The device of this invention comprises a container with a fluid compartment, a plurality of openings to receive more than one finger or toe, and a plurality of spokes to facilitate the removal of nail polish from more than one fingernail or toenail at a time. This device allows a user to simultaneously remove nail polish from all of the fingernails on one hand or all of the toenails on one foot in a fraction of the time required by other methods that only allow for removal of nail polish from one fingernail or toenail at a time. The present invention also includes a cover to prevent leakage of the nail polish removing fluid from the container.

BRIEF DESCRIPTION OF THE DRAWINGS

The accompanying drawings, which are incorporated in and constitute a part of this specification, illustrate several aspects described below.

DETAILED DESCRIPTION OF THE INVENTION

Figure 1:
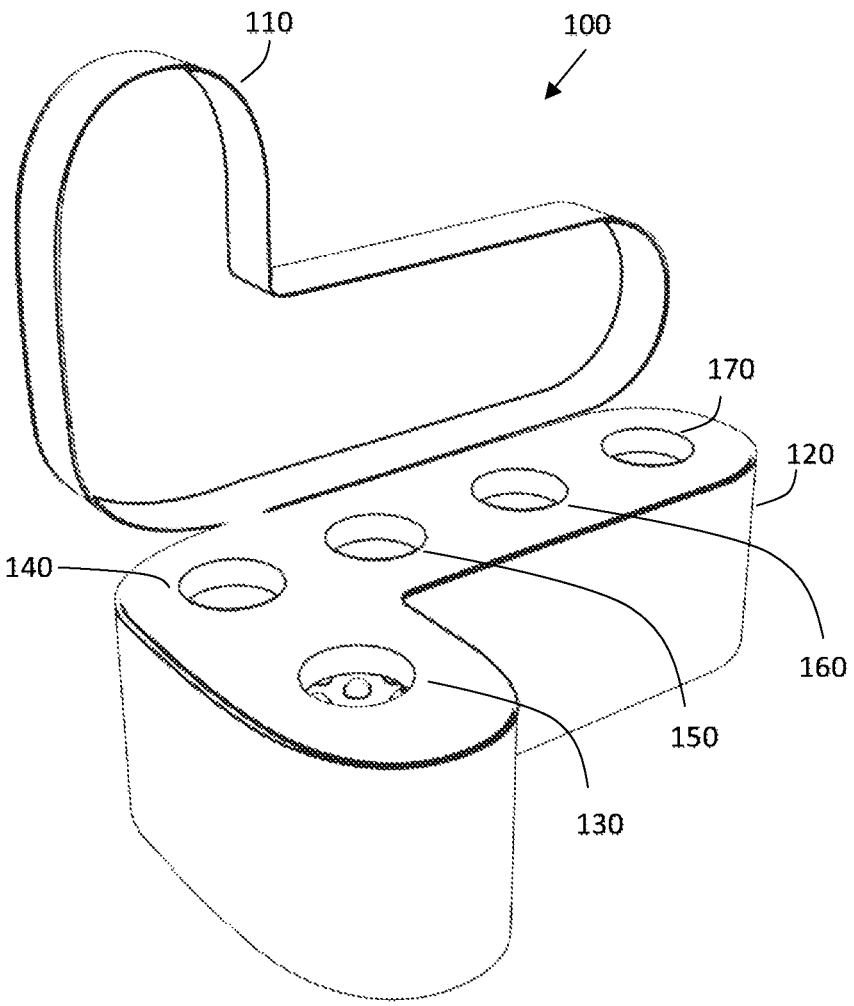
FIG. 1 is a front left perspective illustration of the present invention in which at least one of the embodiments of this invention is implemented.

It is to be understood that this invention is not limited to any particular embodiment described, which may vary. Also, it is to be understood that the terminology used herein is for the purpose of describing particular embodiments only, and is not intended to be limiting, since the scope of this invention will be limited only by the appended claims.

In the following detailed description, numerous specific details are set forth in order to explain and provide a thorough understanding of the present invention. However, it is apparent that the present invention may be practiced without all of these specific details. Thus, all illustrations of the drawings are for the purpose of describing versions of the present invention, and are not intended to limit the scope of the invention.

In the following section, the present invention is described fully by referencing the details in the enclosed drawings, which illustrate certain embodiments of the invention. The numbers shown in this specification refer to the corresponding numbers in the enclosed drawings. The terminology used is to describe the particular embodiment shown and is not intended to limit the scope of the invention. The invention may also be embodied in many other forms in addition to the embodiments shown. Thus, the embodiments shown should not be construed as limiting, but rather, to allow a thorough and complete description of the disclosure that conveys the scope of the invention to a person having ordinary skill in the art in the field of this invention. Therefore, for the terms used herein, the singular forms "the," "a," and "an" are intended to include the plural forms as well as the singular forms, unless the context clearly indicates otherwise. The term "and" includes any and all combinations of one or more of the associated listed items. As used herein, the terms "comprising" and "comprises" when used in this specification, identify specific steps, integers, operations, features, components, and elements, but do not preclude the presence or addition of one or more other steps, operations, features, components, and elements. In addition, the features, components, and elements referenced may be exaggerated for clarity.

Unless otherwise defined, all scientific terms, technical terms, or other terms used herein have the same meaning as the term that is understood by one having ordinary skill in the art in the field of this invention. It is also understood that these terms, including their dictionary meaning, should be understood as having the meaning, which is consistent with their definitions in the related relevant art. In addition, the present disclosure is not to be interpreted in an idealized or overly formal sense unless expressly stated so herein. Constructions or functions that are well known in the art may not be fully described in detail for brevity.

In describing the invention, it is understood that a number of steps and methods may be disclosed. Each of these may have individual benefit. Also, each may be used in conjunction with at least one or more of the disclosed steps and methods. Therefore, this description will refrain from stating each and every possible combination of the individual steps and methods for the sake of brevity. Regardless, the specification and related claims should be understood with the combinations that are entirely within the scope of the claims and inventions.

The disclosure in this invention are examples of how it may be implemented and are not intended to limit the scope of the invention to the specific embodiments shown in the accompanying drawings or the description provided herein. All illustrations are for the purpose of describing selected versions of the present invention and are not intended to limit the scope of the present invention. The present invention will now be described by example in the following paragraphs by referencing the accompanying drawings, which represent embodiments and alternative embodiments. All illustrations of the drawings are for the purpose of describing selected versions of the present invention and are not intended to limit the scope of the present invention.

Figure 2:
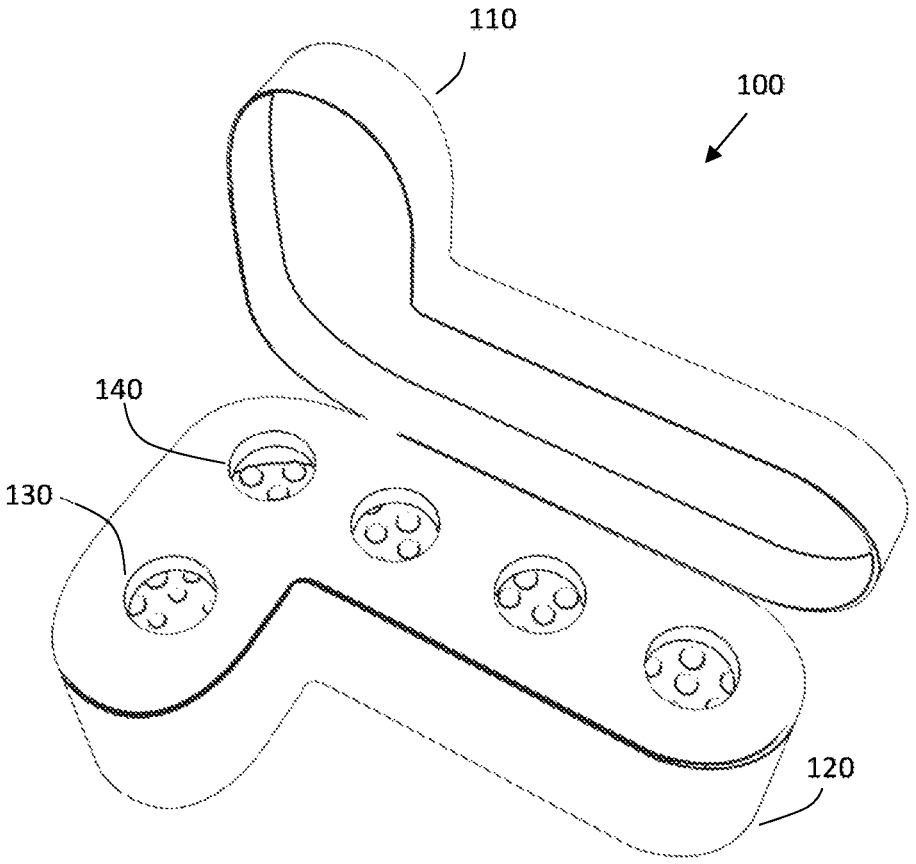
FIG. 2 is a front right perspective illustration of the present invention in which at least one of the embodiments of this invention is implemented.
Figure 3:
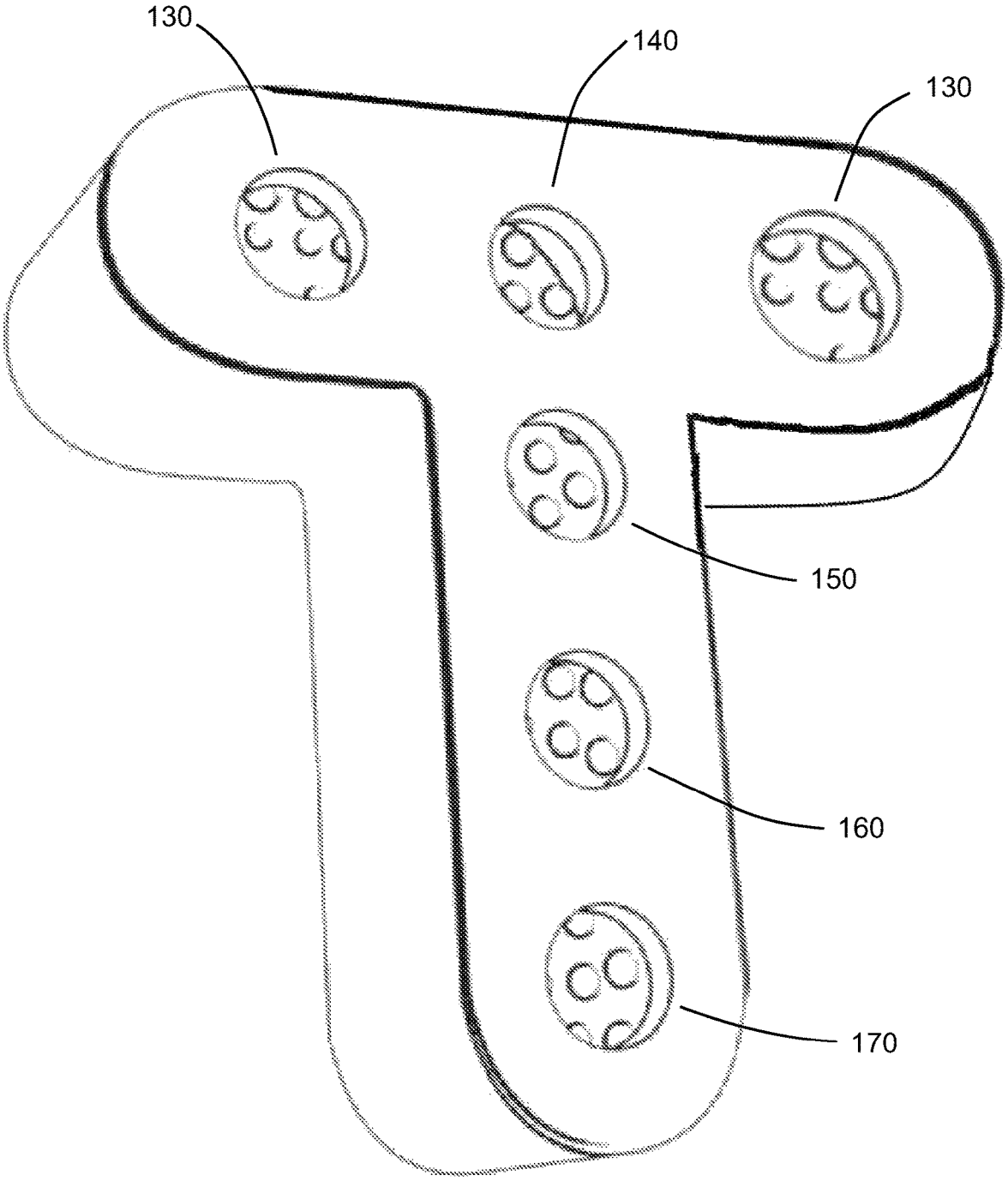

In at least one embodiment of the present invention, the container 100 has an L-shape as shown in FIG. 1 and FIG. 2. The L-shaped container 100 may be designed to accommodate either the user's right or left hand. While the configuration shown in FIG. 1 and FIG. 2 is to accommodate the user's right hand, it is understood that a mirror of the L-shaped container 100 may be designed to accommodate the user's left hand.

In reference to FIG. 1 and FIG. 2, the present invention is a nail polish removing device comprising an L-shaped container 100 with a cover 110 and a reservoir for holding fluids 120 with a base and sidewalls. The cover 110 securely attaches to the sidewalls to prevent leakage of the nail polish removing fluid from the container.

The L-shaped container 100 also comprises a plurality of openings with a hole to accommodate the thumb 130. The L-shaped container 100 also comprises four holes to accommodate the other fingers; specifically, the index finger 140, which is also referred to as the forefinger, first finger, pointer finger, trigger finger, or digitus secundus; the middle finger 150, which is also referred to as the long finger, tall finger, digitus medius, or digitus tertius; the ring finger 160, which is also referred to as the fourth finger, digitus medicinalis, digitus annularis, or digitus quartus; and the pinkie finger 170, which is also referred to as the little finger, pinky finger, or the fifth digit. In at least one alternative embodiment, the device may also be used to remove nail polish from a user's toenails.

As shown in FIG. 1 and FIG. 2, the shorter segment on the left-hand end of the L-shaped container 100 comprises at least one hole for the thumb 130, which is situated at the distal end of the shorter segment. The longer segment of the L-shaped container 100 comprises at least one hole for the index finger 140, which is situated at the proximal end of the shorter segment where it intersects the longer segment of the L-shaped container 100. Adjacent and to the right of the hole for the index finger 140 along the longer segment of the L-shaped container 100 comprises the hole for the middle finger 150. Adjacent and to the right of the hole for the middle finger 150 along the longer segment of the L-shaped container 100 comprises the hole for the ring finger 160. Adjacent and to the right of the hole for the ring finger 160 along the longer segment of the L-shaped container 100 comprises the hole for the pinkie finger 170.

In at least one alternative embodiment of the present invention, a separate L-shaped container may be designed to accommodate the user's left hand. In this configuration, the shorter segment of the L-shaped container may be located on the right-hand end and comprise at least one hole for the thumb, which may be situated at the distal end of the shorter segment. The longer segment of the L-shaped container may comprise at least one hole for the index finger, which is situated at the proximal end of the shorter segment where it intersects the longer segment of the L-shaped container. Adjacent and to the left of the hole for the index finger along the longer segment of the L-shaped container comprises the hole for the middle finger. Adjacent and to the left of the hole for the middle finger along the longer segment of the L-shaped container comprises the hole for the ring finger. Adjacent and to the left of the hole for the ring finger along the longer segment of the L-shaped container comprises the hole for the pinkie finger.

In at least one alternative embodiment of the present invention, there is a larger opening for the user's thumb located on the left hand side to facilitate a comfortable position for the user's right hand when the user's fingertips and thumb are inserted into said device.

In at least one alternative embodiment of the present invention, there is a larger opening for the user's big toe located on the left hand side to facilitate a comfortable position for the user's right foot when the user's toes are inserted into said device.

In at least one alternative embodiment of the present invention, there is a larger opening for the user's thumb located on the right hand side to facilitate a comfortable position for the user's left hand when the user's fingertips and thumb are inserted into said device.

In at least one alternative embodiment of the present invention, there is a larger opening for the user's big toe located on the right hand side to facilitate a comfortable position for the user's left foot when the user's toes are inserted into said device.

In at least one other alternative embodiment of the present invention, the container may be designed in a T-shape to accommodate both the user's right and left hand. In this configuration, the container may accommodate one of the user's hands at a time. Similar to the configuration shown in FIG. 1 and FIG. 2, the shorter segment on the left-hand end of the T-shaped container may comprise two holes, one for each thumb. One hole for the right thumb may be situated at one end of the shorter segment of the T-shaped container, while the other hole for the left thumb may be situated at the other end of the shorter segment of the T-shaped container. At least one hole for the index finger may be situated where the shorter segment of the T-shaped container intersects the longer segment of the T-shaped container. At least one hole for the middle finger may be situated to the immediate right of the hole for the index finger. At least one hole for the ring finger may be situated to the immediate right of the hole for the middle finger. At least one hole for the pinky finger may be situated to the immediate right of the hole for the ring finger.

In at least yet one other alternative embodiment of the present invention, the container may be designed in a T-shape to accommodate both the user's right and left hand at the same time. As described above, the shorter segment on the left-hand end of the T-shaped container may comprise two holes, one for each thumb. One hole for the right thumb may be situated at one end of the shorter segment of the T-shaped container, while the other hole for the left thumb may be situated at the other end of the shorter segment of the T-shaped container. At least two holes, one for the user's right index finger and one for the user's left index finger, may be situated where the shorter segment of the T-shaped container intersects the longer segment of the T-shaped container. At least two holes, one for the user's right middle finger and one for the user's left middle finger, may be situated to the immediate right of the holes for the index finger. At least two holes, one for the user's right ring finger and one for the user's left ring finger, may be situated to the immediate right of the holes for the middle finger. At least two holes, one for the user's right pinky finger and one for the user's left pinky finger, may be situated to the immediate right of the holes for the ring finger.

The container may be composed of any material that is chemically resistant to acetone, such as plastic, nylon, Teflon, polypropylene (PP), high-density polyethylene (HDPE), polypropylene copolymer (PPCO), Polytetrafluoroethylene (PTFE), Tetrafluoroethylene (TFE), Fluorosint Enhanced PTFE (FEPTFE), Polymethylpentene (PMP), Fluorinated ethylene propylene (FEP), Ethylene ChloroTriFluoroEthylene (ECTFE), and Polyphenylene (PPS). The container may be of various shapes and sizes to accommodate users with either small or large hands.

The L-shaped container 100 may be approximately four to eight inches in length, approximately four to eight inches in width, and with a height of approximately one to three inches. The plurality of openings is positioned at the top of the container, where they traverse the top of the container in a direction perpendicular to the long sides of the top of the container. The plurality of openings may be any size and shape to accommodate various diameters of fingers.

In at least one of the embodiments of the present invention, each of the plurality of openings is sized and shaped to allow a finger of a hand to be inserted. Also, at least one of the plurality of openings is sized and shaped to allow a thumb of a hand to be inserted.

In at least one other embodiment of the present invention, the plurality of openings further comprises a large opening and a thumb opening. The large opening is sized and shaped to receive all the forefingers of a hand. The thumb opening is sized and shaped to receive the thumb of a hand. The thumb opening is spaced from the other openings to allow the user to comfortably insert each of their fingers and thumb into the plurality of openings. Thus, the arrangement of holes in the L-shaped container 100 allows the user to comfortable insert their fingers into the container in a relaxed position.

The plurality of openings lead to the inside of the container, which is a fluid holding compartment. The fluid holding compartment is able to hold a fluid, which may be, a nail polish removing fluid such as acetone. The internal sidewalls of the container are positioned within the container.

The internal sidewalls further comprise a plurality of spokes. The plurality of spokes may be composed of a flexible material that is chemically resistant to acetone, such as plastic, nylon, Teflon, PP, HDPE, PPCO, PTFE, TFE, FEPTFE, PMP, FEP, ECTFE, or PPS. The plurality of spokes may be any size and shape to scrape against a user's fingernails. The plurality of spokes extends from the internal sidewalls towards the center of the container in a perpendicular fashion from the internal sidewalls. The plurality of spokes allows the user to rub their fingernails to facilitate the removal of nail polish in conjunction with the nail polish removing fluid.

The cover is positioned at the top of the container. The container may comprise a lip for the cover to be snap-fitted onto the container providing a secured seal to prevent leakage of fluid from the container. The container may also comprise a female threading. The cover may comprise a male threading. The cover may be threaded onto the container providing a secure seal between the cover and container.

The base is positioned at the bottom of the container. The base may comprise a bottom material to prevent the container from slipping when placed on a surface and to prevent damage to the surface. This bottom material may be selected from the group consisting of rubber, cork, vinyl, cloth, suction pads, or any other slip resistant material.

Although the invention has been explained in relation to its at least one embodiment, embodiment, it is to be understood that many other possible modifications and variations can be made without departing from the spirit and scope of the invention as hereinafter claimed.

All of these embodiments and the invention disclosed herein are intended to be within the scope herein disclosed. These and other embodiments of the invention will become readily apparent to those skilled in the art from the detailed description of the embodiments having reference to the attached figures, the embodiments not being limited to any particular embodiments disclosed. Also, the invention disclosed herein suitably may be practiced in the absence of any element which is not specifically disclosed herein.

What is claimed is:

1. A device for removing nail polish from the fingernails of a user, the device comprising:

a. at least one L-shaped container configured to receive a user's fingertips, said L-shaped container is approximately four to eight inches in length, approximately four to eight inches in width, and with a height of approximately one to three inches comprising;

b. a base, sidewalls, a plurality of openings, and a reservoir for holding fluids, where material for said base and sidewalls are made of material that is chemically resistant to acetone, said material is selected from the group consisting of plastic, nylon, polytetrafluoroethylene, polypropylene (PP), high-density polyethylene (HDPE), polypropylene copolymer (PPCO), Polytetrafluoroethylene (PTFE), Tetrafluoroethylene (TFE), Fluorosint Enhanced PTFE (FEPTFE), Polymethylpentene (PMP), Fluorinated ethylene propylene (FEP), Ethylene ChloroTriFluoroEthylene (ECTFE), and Polyphenylene (PPS);

c. a plurality of spokes that extend from the internal surface of the sidewalls towards the center of the container in a perpendicular fashion from the internal surface of the sidewalls, where material for said spokes are made of material that is chemically resistant to acetone, said material is selected from the group consisting of plastic, nylon, polytetrafluoroethylene, polypropylene (PP), high-density polyethylene (HDPE), polypropylene copolymer (PPCO), Polytetrafluoroethylene (PTFE), Tetrafluoroethylene (TFE), Fluorosint Enhanced PTFE (FEPTFE), Polymethylpentene (PMP), Fluorinated ethylene propylene (FEP), Ethylene ChloroTriFluoroEthylene (ECTFE), and Polyphenylene (PPS);

d. a cover that prevents leakage of the nail polish removing fluid from the container;

e. a lip for the cover to be snap-fitted onto the container for connecting together the reservoir and cover of said L-shaped container; and f. a plurality of openings sized and shaped for allowing a user to insert their fingertips in and out in a manner to remove fingernail polish.

2. The device according to claim 1, wherein the reservoir further comprises a fluid such as acetone to assist the spokes in removing nail polish from the user's fingernails.

3. The device according to claim 2, wherein the plurality of openings for the fingers and thumb are so spaced as to facilitate insertion of a user's fingertips and thumb into said device.

4. The device according to claim 2, wherein the L-shaped container comprises a bottom material selected from the group consisting of rubber, cork, vinyl, cloth, and any other slip resistant material.

5. The device according to claim 1, wherein the reservoir further comprises a fluid such as acetone to assist the spokes in removing nail polish from the user's toenails.

6. The device according to claim 5, wherein the plurality of openings for the toes are so spaced as to facilitate insertion of a user's toes into said device.

* * * * *